US008801306B2

(12) United States Patent
Lakin et al.

(10) Patent No.: US 8,801,306 B2
(45) Date of Patent: Aug. 12, 2014

(54) PRINTING APPARATUS AND METHOD OF PRINTING WITH RIBBON TENSION ADJUSTMENT USING MOVABLE RIBBON GUIDE MEMBERS

(75) Inventors: Phillip Lakin, Nottingham (GB); Stephen Carter, Tory, NH (US)

(73) Assignee: Markem-Imaje Industries Limited, Nottingham (GB)

( * ) Notice: Subject to any disclaimer, the term of this patent is extended or adjusted under 35 U.S.C. 154(b) by 412 days.

(21) Appl. No.: 13/048,434

(22) Filed: Mar. 15, 2011

(65) Prior Publication Data

US 2011/0229239 A1 Sep. 22, 2011

Related U.S. Application Data

(60) Provisional application No. 61/315,325, filed on Mar. 18, 2010.

(30) Foreign Application Priority Data

Mar. 16, 2010 (GB) ..... 1004279.4

(51) Int. Cl.
*B41J 33/14* (2006.01)
*B41J 35/08* (2006.01)

(52) U.S. Cl.
CPC . *B41J 33/14* (2013.01); *B41J 35/08* (2013.01)
USPC ..... 400/235; 400/223; 400/234

(58) Field of Classification Search
CPC ..... B41J 35/08; B41J 33/382; B41J 33/38; B41J 33/14; B41J 33/16; B41J 33/20; B41J 17/24; B41J 17/28; B41J 17/02; B41J 17/08
USPC ..... 400/217, 223, 233–235, 225; 242/217, 242/217.1–217.3
See application file for complete search history.

(56) References Cited

U.S. PATENT DOCUMENTS 3,726,381 A * 4/1973 Murphy ..... 400/196.1
3,797,773 A 3/1974 Beery (Continued)

FOREIGN PATENT DOCUMENTS

EP 1974940 B1 10/2008
GB 2306916 A 5/1997

(Continued)

OTHER PUBLICATIONS

UK Intellectual Property Office, GB Application No. GB1004279.4, Search Report dated Jan. 17, 2011.

(Continued)

*Primary Examiner* — Daniel J Colilla
*Assistant Examiner* — Justin Olamit
(74) *Attorney, Agent, or Firm* — Fish & Richardson P.C.

(57) ABSTRACT

Systems and techniques relating to printing include an apparatus including a base mounting a storage spool to store printing ribbon including a web carrying marking medium, the base mounting a ribbon take-up spool. A ribbon path from the storage to the take-up spool runs through a printing station where there is a print head, and printing is effected at the printing station when relatively moving the head and the substrate with the ribbon interposed between. The apparatus includes a movable ribbon guide member, a ribbon guide member drive device to move the ribbon guide member, and a controller which, during or in between at least some printing operations, controls drive of at least the take-up spool to advance ribbon through the printing station. The controller controls the ribbon guide member in response to an input signal representative of ribbon tension along the ribbon path to adjust the ribbon tension.

22 Claims, 4 Drawing Sheets

(56) References Cited

U.S. PATENT DOCUMENTS

| | | | | |
|---|---|---|---|---|
| 5,725,168 | A * | 3/1998 | Yokoyama et al. | 242/334.6 |
| 5,975,777 | A * | 11/1999 | Nelson et al. | 400/223 |
| 6,036,382 | A * | 3/2000 | Middleton | 400/225 |
| 7,413,139 | B2 * | 8/2008 | Benvenuti et al. | 242/421.1 |
| 2004/0245363 | A1 * | 12/2004 | Vaeth | 242/417 |
| 2007/0104526 | A1 | 5/2007 | Squires et al. | |
| 2007/0231041 | A1 | 10/2007 | Ueda et al. | |

FOREIGN PATENT DOCUMENTS

| | | | |
|---|---|---|---|
| GB | 2328181 | A | 2/1999 |
| GB | 2376662 | | 12/2002 |
| GB | 2404896 | A | 2/2005 |
| JP | 2001071609 | A | 3/2001 |
| JP | 2003246110 | A | 9/2002 |
| WO | 97-18089 | | 5/1997 |
| WO | WO08/107648 | A1 | 9/2008 |

OTHER PUBLICATIONS

UK Intellectual Property Office, GB Application No. GB1004279.4, Search Report dated Jul. 8, 2010.

Joosting, Search Report in European Patent Application No. 11158566.7, mailed Jun. 29, 2011, 4 pages, to be published by USPTO.

Joosting, Search Report in PCT International Patent Application No. PCT/GB2011/050468, mailed Jun. 29, 2011, 3 pages, to be published by USPTO.

* cited by examiner

PRINTING APPARATUS AND METHOD OF PRINTING WITH RIBBON TENSION ADJUSTMENT USING MOVABLE RIBBON GUIDE MEMBERS

CROSS REFERENCE TO RELATED APPLICATIONS

This application claims the benefit of the priority of U.S. Provisional Application Ser. No. 61/315,325, filed Mar. 18, 2010 and entitled "Printing Apparatus and Method of Printing", and this application claims the benefit of the priority of UK Patent Application No. 1004279.4, filed Mar. 16, 2010.

BACKGROUND TO THE INVENTION

This invention relates to a printing apparatus for printing on a substrate and to a method of printing. More particularly the invention relates to a printing apparatus which utilises a printing ribbon which includes a web carrying marking medium, a print head in use, removing marking medium from selected areas of the web to transfer the marking medium to the substrate to form an image, such as a picture or text.

More particularly but not exclusively the invention relates to a so called thermal printing apparatus in which the print head includes a plurality of thermal heating elements which are selectively energisable by a controller during printing to soften and remove pixels of marking medium from the ribbon and to transfer such pixels to the substrate. However the invention may be applied to other ribbon using printing apparatus.

The ribbon for thermal printing apparatus tends to be thin both to enable a large quantity of ribbon be to stored on a ribbon storage spool, as well as to ensure the efficient removal of pixels of marking medium from the ribbon. Such ribbon thinness makes the ribbon prone to breakage where ribbon tension changes to outside of tension limits, which breakage especially in an industrial context means production down time.

The ribbon tension also has a direct effect on printing quality, and the speed at which printing may be performed.

It is therefore desirable in a printing apparatus closely to control the ribbon tension.

DESCRIPTION OF THE PRIOR ART

It is known, for example from GB-A-2376662, to utilise sprung "dancing arms" along a ribbon path between the ribbon storage spool and a ribbon take-up spool, a spring of the dancing arm arrangement applying a tension to the ribbon. However the tension applied is largely uncontrolled.

In our prior proposal described in WO-A-97/18089, ribbon movement past a print head is effected by a shuttle rather than by pulling the ribbon though a printing station where the print head is provided, by driving a ribbon take-up spool. It has been found that in such an arrangement ribbon breakages are reduced, but perhaps more importantly, because there is no requirement to accelerate a ribbon to the speed desired for printing by turning one or both of a relatively high mass ribbon supply and take up spool, but a short length only of ribbon is moved by the shuttle movement, faster printing can be achieved.

SUMMARY OF THE INVENTION

According to a first aspect of the invention we provide a printing apparatus for printing on a substrate, the apparatus including a base mounting a storage spool for storing printing ribbon of the kind including a web carrying marking medium, and the base mounting a ribbon take-up spool for taking up ribbon, and there being a ribbon path from the storage to the take-up spool through a printing station where there is a print head, printing being effected at the printing station when relatively moving the print head and the substrate with the ribbon interposed between substrate and print head so that marking medium is transferred from the ribbon web to the substrate, and wherein the apparatus includes a movable ribbon guide member about which the ribbon is entrained along the ribbon path, a ribbon guide member drive device for moving the movable ribbon guide member, and there being a controller which, during or inbetween at least some printing operations, controls drive of at least the take-up spool to advance ribbon through the printing station, and the controller controlling the movable ribbon guide member in response to an input signal representative of the ribbon tension along the ribbon path to adjust the ribbon tension in the ribbon path.

Thus by controlling the movable ribbon guide member, in response to the input signal representative of ribbon tension, ribbon guide member movement may maintain ribbon tension in the ribbon path between predetermined limits.

Although the movable ribbon guide member may be moved whenever the ribbon is stationary, to adjust ribbon tension, such movement may especially be effected before or after a printing operation to adjust the ribbon tension in an effort to maintain the ribbon tension along the ribbon path between the predetermined tension limits.

The invention is particularly but not exclusively useful in one embodiment where the printing apparatus is of the kind in which at least the ribbon take-up spool is driven to take-up ribbon, so that fresh ribbon is pulled from the ribbon storage spool.

More desirably both the ribbon take-up and ribbon storage spools are driven during a printing operation or inbetween printing operations, to effect a more controlled push-pull ribbon movement.

In another arrangement, if desired, ribbon tension adjustment may be effected by moving the movable ribbon guide member during a printing operation when the ribbon may be stationary, as in the case of a so called intermittent type of printing apparatus, or even when the ribbon is moving in a so called continuous type of printing apparatus.

If desired such a printing apparatus may be operated to rewind used ribbon from the take-up spool into the ribbon path, for ribbon saving purposes i.e. so that a used length of ribbon may be reused in a subsequent printing operation.

The ribbon guide member drive device may include a motor which turns a lead screw which is received by a female threaded transmission part of the ribbon guide member, or the ribbon guide member drive device may include a motor which drives a drive belt which carries the ribbon guide member, the belt being entrained around a pair of spindles, at least one of which may be drivable by a motor to effect ribbon guide member movement.

In a second embodiment, the movable ribbon guide member may include a pair of ribbon guide member parts about which the ribbon is entrained, the pair of ribbon guide member parts being movable together in a first direction during printing, to effect ribbon movement through the printing station usually whilst the ribbon storage and ribbon-take up spools are both stationary. The pair of ribbon guide member parts may thus provide the equivalent of a shuttle, although the pair of ribbon guide member parts would additionally need to be differentially movable under the control of the controller, to adjust the ribbon tension in the feed path i.e. the distance between the pair of ribbon guide member parts is adjustable by operation of the ribbon guide member drive device, preferably when the ribbon is stationary.

Such a printing operation lends itself particularly to so called continuous printing.

Before or after a printing operation, when the pair of ribbon guide members are movable together in a second direction opposite to the first direction, the ribbon storage and ribbon take-up spools may both be rotated, with the ribbon take-up spool taking-up used ribbon from the ribbon path and the ribbon supply spool passing fresh ribbon into the ribbon path ready for a subsequent printing operation.

Desirably for the second embodiment, the ribbon guide member drive device includes a first motor which drives one of the ribbon guide member parts in the first and second directions and a second motor which drives the other of the pair of ribbon guide member parts in the first and second directions. The first and second ribbon guide member part drive device motors, may typically each be a stepper motor which can be closely controlled by the controller.

In a modification to the second embodiment, each of the ribbon guide member parts of the pair of ribbon guide member parts, may include a pair of ribbon guide member elements about which the ribbon is entrained, the ribbon being entrained about a base-mounted ribbon path guide inbetween being entrained about the respective ribbon guide member elements.

In this way, ribbon movement along the ribbon path for a given movement together of the pair of ribbon guide member parts, can be increased.

The printing apparatus may include a ribbon tension sensing device which may be positioned at any convenient point to sense ribbon tension in the ribbon feed path. Such a device may include a strain sensor incorporated into a base mounted ribbon path guide, or the sensor device may sense tension related movement of a movable base mounted ribbon guide member. In each case the controller responds to a signal from the ribbon sensing device to effect movement of the ribbon guide member to control ribbon tension.

It will be appreciated that for continuous printing the substrate moves through the printing station with the ribbon during a printing operation, although to achieve some ribbon saving, if desired the ribbon may be driven through the printing station at a rate less than the rate of passage of the substrate. Desirably the print head is stationary at the print station, although if desired to enable printing to be performed on substrates which are moving at a speed too great or too slow for printing, the print head may also be moved in the print station during printing, in the same direction as the substrate and ribbon movement where the substrate speed is too great for printing, or in an opposite direction as the substrate and ribbon where the substrate speed is to slow.

The printing apparatus may be a thermal printing apparatus in which the print head includes a plurality of thermal heating elements which are selectively energisable by a controller during printing to soften and remove pixels of marking medium from the ribbon and to transfer such pixels to the substrate. Desirably the controller co-ordinates ribbon movement and thermal print head energisation.

However the invention may be applied to other ribbon using printing apparatus.

According to a second aspect of the invention we provide a method of operating a printing apparatus according to any one of the preceding claims the method including controlling the movable ribbon guide member in response to a signal representative of the ribbon tension along the ribbon path to adjust ribbon tension the ribbon path.

According to a third aspect of the invention we provide a printing apparatus for printing on a substrate, the apparatus including a base mounting a ribbon storage spool and a ribbon take-up spool for taking up ribbon, and there being a ribbon path from the storage to the take-up spool through a printing station where there is a print head, and wherein the apparatus includes a ribbon guide member about which the ribbon is entrained along the ribbon guide path, a ribbon guide member drive device for moving the ribbon guide member, the ribbon guide member including a pair of ribbon guide member parts about which the ribbon is entrained, the parts being movable together by the ribbon guide member drive device to effect ribbon movement at the printing station, and wherein each of the ribbon guide member parts of the pair of ribbon guide member parts, including a pair of ribbon guide member elements about which the ribbon is entrained, the ribbon being entrained about a base-mounted ribbon path guide inbetween being entrained about the respective guide member elements.

The printing apparatus of the third aspect of the invention may have any of the features of the printing apparatus of the first aspect of the invention.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
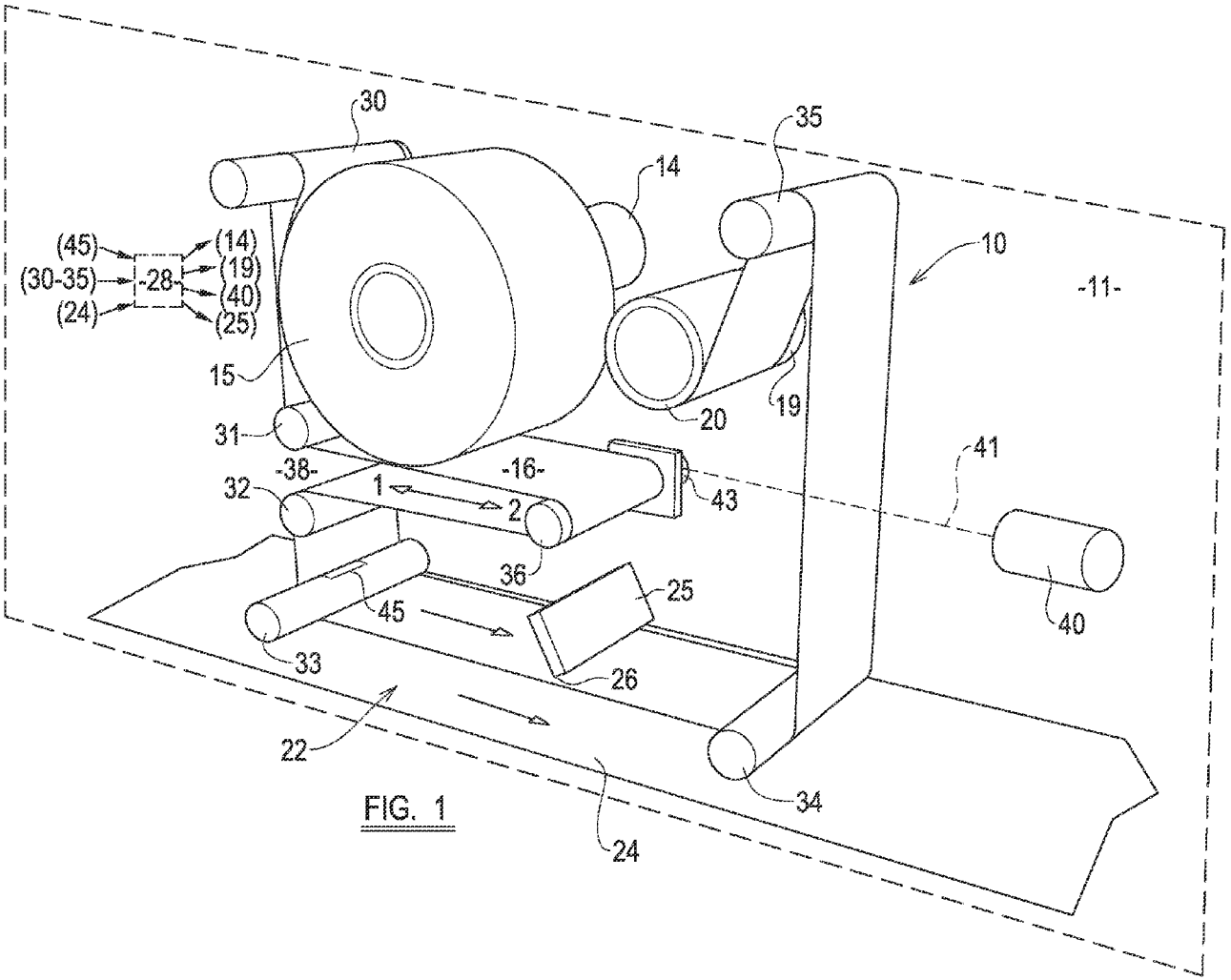
FIG. 1 is an illustrative perspective view from a front of a first embodiment of a printing apparatus in accordance with the first aspect of the invention.

Referring to FIG. 1 of the drawings a printing apparatus 10 includes a base 11, which typically will include a plurality of component parts. The base 11 mounts a respective drive motor 14, a ribbon storage spool 15 for storing ribbon 16 of the kind which includes a web carrying a marking medium such as a plastic material which softens when heated and is removable for transference to a substrate 24 as explained below.

The base 11 further mounts a further drive motor 19, a ribbon take-up spool 20. In use ribbon 16 transfers from the storage spool 15 to the take-up spool 20 along a ribbon path between the storage and take-up spools 15, 20, via a printing station 22 where printing is effected on a substrate 24 by a print head 25.

In this example, the printing apparatus 10 is a so called thermal printer, the print head 25 including a plurality of selectively energisable printing elements along an edge 26 of the print head 25. Each printing element when selectively energised during a printing operation, locally heats the ribbon 16 to soften and remove a pixel of the marking medium from its web and transfer it to the substrate 24. The printing elements are controlled by a controller 28, which co-ordinates energisation of selected printing elements with substrate 24 and ribbon 16 movement, in order to print a desired image, being a picture and/or text, on the substrate 24. The print head 25 is shown simplified. This may include other components, such as a peel roller to facilitate separation of the pixels from the web, and means for moving the print head 25 towards and away from the ribbon 16.

In this example, the printing apparatus 10 is a so-called continuous printer in which the print head 25 is maintained stationary at the printing station 22 and the substrate 24 and ribbon 16 are moved continuously past the print head 25 during printing. However the print head 25 is movable towards the ribbon 16 and substrate 24 for printing by means of a suitable actuator (not shown), and away from the ribbon 16 and substrate 24 when printing is not being effected.

The printing elements on the edge 26 of the print head 25 are in a linear array, and thus differential movement between the print head 25 and the substrate 24 is required to print a two dimensional image. In this example, as the print head 25 is stationary, the substrate 24 is moved relative to the print head 25 during printing, as the substrate 24 is conveyed through the printing station 22. Moreover the ribbon 16 is required to move relative to the stationary print head 25 during printing so in order that ribbon 16 with marking medium is continuously available. However as will be mentioned below, ribbon saving techniques may be utilised which enable ribbon 16 to be transported back past the print head 25 for multiple use inbetween printing.

Typically, the ribbon 16 and substrate 24 will be moved together at substantially the same speed past the stationary print head 25 during a printing operation although again, for ribbon saving reasons, the ribbon 16 can be moved slower past the print head 25 than the substrate 24, albeit at the expense of print quality.

In the example, the base 11 mounts a plurality of ribbon path ribbon guides 30, 31, 32, 33, 34, and 35. Each such ribbon path ribbon guide 30, 31, 32, 33, 34, and 35 in the example, is provided by a roller which rotates on a spindle, to minimise friction between the thin ribbon 16 and the guide as the ribbon 16 is transported around the ribbon path.

A first ribbon path ribbon guide 30 is located adjacent the ribbon storage spool 15, whilst second and third ribbon path ribbon guides 31, 32 provide between them a space 38 for a purpose to be explained, and the fourth ribbon path ribbon guide 33 guides the ribbon 16 into the printing station 22. The fifth ribbon path ribbon guide 34 guides the ribbon 16 from the printing station 25, and the sixth ribbon path ribbon guide 35 guides the ribbon 16 onto the take-up spool 20.

In accordance with the present invention a movable ribbon guide member 36 is provided which is moveable relative to the base 11, linearly in the space 38, the movable ribbon guide member 36 having the ribbon 16 entrained about it. In this example, the movable ribbon guide member 36 is movable generally parallel to the direction in which the substrate 24 passes through the printing station 22.

The movable ribbon guide member 36 is movable by a ribbon guide member drive device which includes in this example, a motor 40 which rotates a lead screw 41, which is received by a female threaded transmission part 43 of the movable ribbon guide member 36. In another example, the member 36 can alternatively be driven, e.g. by being carried on a drive belt entrained about spindles, at least one of the spindles being driven by a motor.

In FIG. 1, the printing apparatus 10 is shown in a condition immediately prior to a printing operation being carried out, with the print head 25 moved towards and into contact with the ribbon 16 at the printing station 22, with the ribbon 16 in the print station 22 interposed between the print head 25 and the substrate 24. The ribbon guide member 36 is positioned so that the ribbon 16 is tensioned so that the ribbon 16 along the ribbon path is adequately taught, but is not stretched, for maximum print quality and printing speed.

When the substrate 24 or a length of the substrate 24 on which it is desired to print an image, moves through the printing station 22, the controller 28 provides a command signal to the print head 25 so that selected printing elements of the edge 26 will be energised sequentially as the substrate 24 moves. Also the controller 28 will operate the storage spool drive motor 14 and the take-up spool drive motor 19 to drive the storage and take-up spools 15, 20 to feed ribbon 16 along the ribbon path from the storage spool 15 onto the take-up spool 20, in so called push-pull mode. The two motors 14, 19 are preferably driven so that the same amount of ribbon is paid out of the storage spool 15 as is taken up by the take-up spool 20.

In another example, during such a printing operation the storage spool 15 may not be driven. This ribbon 16 is thus moved solely as a result of the take-up spool 20 movement pulling ribbon 16 from the storage spool 15 to enable ribbon 16 movement through the printing station 22. However a push-pull drive arrangement is preferred, and desirably both of the drive motors 14, 19 are stepper motors, to facilitate their accurate control.

Subsequent to carrying out a printing operation, the print head 25 may be moved away from the ribbon 16 by operating the actuator, or a spring device may thus move the print head 25, so that as desired, the previously printed substrate 24 length may continue to be moved from the print station 22 so that a fresh substrate 24 or substrate length may be presented at the printing station 22 for a subsequent printing operation.

Desirably when the ribbon 16 is stationary, inbetween printing operations, depending on the ribbon 16 tension sensed as described below, the controller 28 may operate the ribbon guide member drive device motor 40 to move the guide member 36 in either linear direction 1-2 in the space 38, e.g. towards or away from the second and third ribbon guides 31, 32, to adjust the ribbon tension to within acceptable limits.

If desired, to effect ribbon saving, at least some previously used ribbon 16 may be re-wound inbetween printing operations, for a second (or other multiple) use at the printing station 22. This may be achieved by the controller 28 contra-rotating the take-up spool 20 to return used ribbon 16 to the ribbon path, and rotating of the storage spool 15 to take up ribbon 16 from the ribbon feed path.

One of the ribbon guides 30, 31, 32, 33, 34, 35 around the ribbon path, or even the movable ribbon guide member 36, has a ribbon tension sensor attached thereto, as indicated in the example at 45 on the fourth guide member 33. The sensor 45 typically is a strain gauge which provides a signal to the controller 28 which is indicative of the ribbon 16 tension along the ribbon path. The controller 28 utilises the tension signal to maintain the ribbon tension in the ribbon path within acceptable parameters, by adjusting the movement or position of the ribbon guide member 36 to increase or decrease the ribbon tension.

In another example, a ribbon tension sensor input to the controller 28 may be provided by permitting movement of one of the guides 30 to 35 e.g. against a spring, or other resilient force, in response to changes in ribbon tension, the amount of guide movement being determined to generate a signal to the controller 28 indicative of ribbon tension.

Although the controller 28 may use complex algorithms to calculate the ribbon tension from the signal from the sensor 45 or other sensor and to determine an amount of and direction of ribbon guide member 36 movement required between printing operations to adjust the ribbon tension to maintain the ribbon tension within acceptable limits, preferably a simple method is utilised.

The printing apparatus 10 is calibrated so that when the magnitude of the signal from the ribbon tension sensor 45 is greater than a first threshold, the ribbon guide member 36 is moved in the first direction 1 until the magnitude of the signal is within an acceptable range. If the magnitude of the signal is less than a second threshold lower than the first threshold, the ribbon guide member 36 is moved in the second direction 2 until the magnitude of the signal from the ribbon tension sensor 45 is within the acceptable range. In this way the ribbon tension in the ribbon path can be adjusted so as to be maintained within predetermined ribbon tension limits.

An alternative ribbon tension adjustment may be performed as follows.

In the event that the controller 28 receives a ribbon tension signal which indicates that the ribbon tension is greater than desirable, the motor 40, which typically is a stepper motor, is operated to move the movable ribbon guide member 36 in direction '1' in the space 38, a set amount; for example, where the motor 40 is a stepper motor this may be stepped, a set number of steps e.g. 12 steps. Then the controller 28 may receive an updated ribbon tension signal from the sensor 45 or otherwise, and if the ribbon tension is still greater than desirable, the motor 40 may be stepped another set number of steps, e.g. 12 steps again, and so on until the ribbon tension is sensed to be within acceptable limits.

If the sensed ribbon tension is less than is desirable, the same method may be performed but with the movable ribbon guide member 36 being moved by operating the motor 40 to step a set number of steps, in direction '2'.

Various modifications may be made to the embodiment described, particularly in relation to the layout of the various components, such as the placing of and number of the ribbon guides 30, 31, 32, 33, 34 and 35. With a different layout the direction of movement of the movable ribbon guide member 36 need not be linear parallel with the substrate 24 movement direction as described, but can be otherwise.

Whereas the base 11 can be provided by a plate-like part with the spools 15, 20 and guides 30-35, the print head 25 and the movable ribbon guide member 25 can be substantially at one side of the plate and their respective drive motors 14, 19 and 40, and the controller 28 can be on the other side of the plate. The base 11 may include a fixed base part which includes the movable ribbon guide member 36 and its drive motor 40 etc., the print head 25 and the controller 28, but the spools 15, 20 and the guides 30-35 may be provided on a cassette which is removable from the fixed base part to facilitate ribbon 16, changing and maintenance.

If desired the invention may be applied to a printing apparatus 10 which is configured for intermittent printing. In such an example, during a printing operation the print head 25 moves at the print station 22 whilst the substrate 24 and ribbon 16 may be stationary. In this event, the ribbon 16 tension may be sensed and the movable ribbon guide member 36 moved to effect a change in ribbon tension as required inbetween printing operations, before or preferably after, rotating the spools 15, 20 to provide fresh ribbon 16 at the printing station 22 for the next print. At the least the ribbon 16 tension is sensed when the ribbon 16 is stationary.

In yet another arrangement, in a continuous printing operation, both the ribbon 16 and substrate 24 and the print head 25 may move at the printing station 22 during printing, e.g. to enable printing to be effected where the substrate 24 is moving at too high or too low a speed for the print head 25 to print when stationary. Again the ribbon 16 tension may be sensed when the ribbon 16 is stationary, before but preferably after any ribbon 16 winding after a printing operation.

Although it is preferred for the ribbon tension to be sensed, and ribbon tension adjustment to be effected inbetween printing operation when the ribbon 16 is stationary, if desired ribbon tension can be sensed during printing, and/or when the ribbon 16 is moved, ribbon tension adjustment can be effected at such times.

Figure 2:
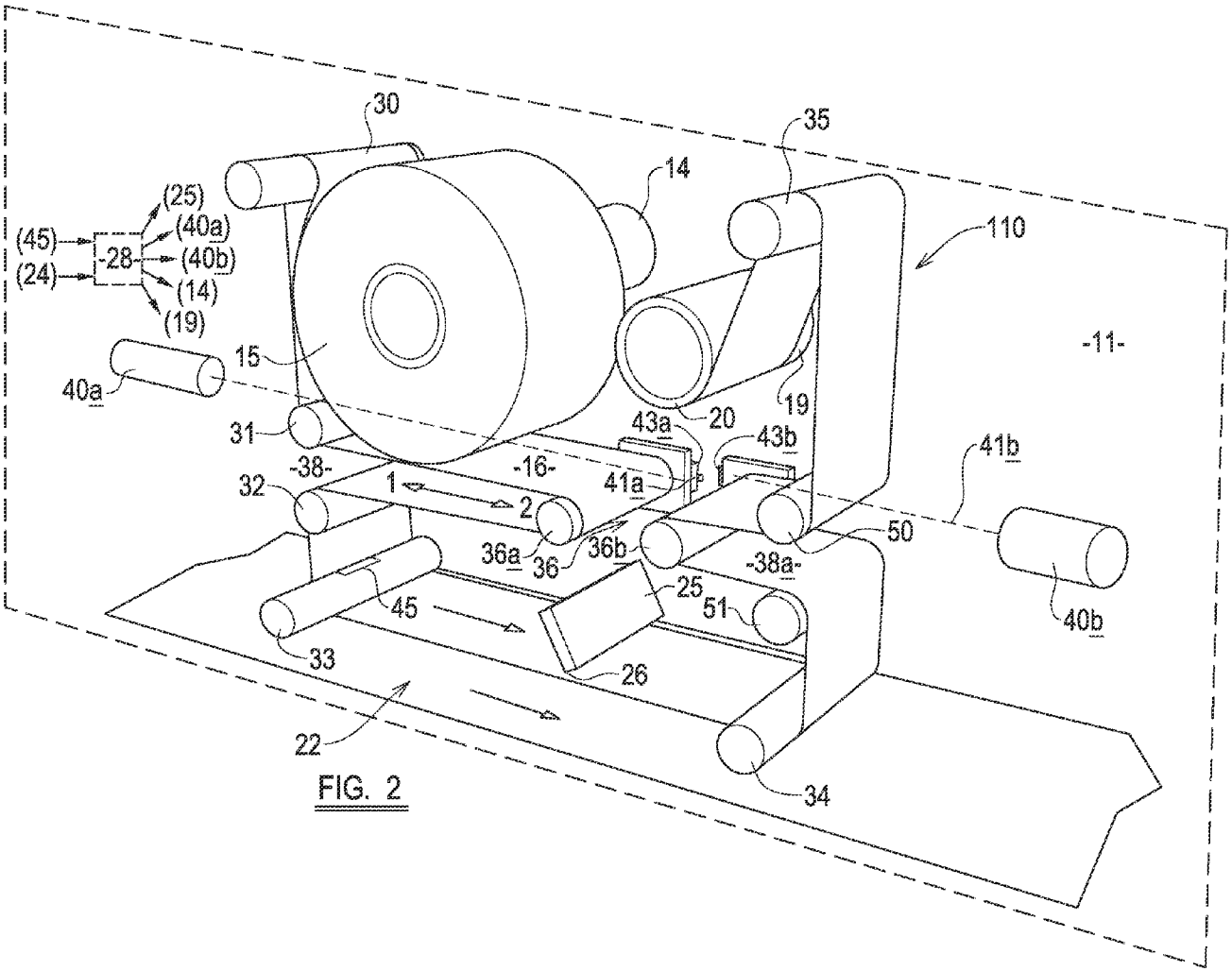
FIG. 2 is a view similar to FIG. 1, but of a second aspect of the invention.

Referring now to FIG. 2 there is shown an alternative embodiment of printing apparatus 110 in accordance with the invention. Similar parts to those of the printing apparatus 10 of FIG. 1 are given the same references.

The printing apparatus 110 differs from that of FIG. 1 in the nature of the movable ribbon guide member 36 which in this embodiment includes a pair of movable ribbon guide member parts 36*a*, 36*b*. Each movable ribbon guide member part 36*a*, 36*b* is individually movable in first 1 and second 2 directions by its own respective drive motor 40*a*, 40*b* and lead screw 41*a*, 41*b* of the ribbon guide member drive device.

The ribbon path of the printing apparatus 110 further includes a further pair of ribbon guides 50, 51 which are provided between the fifth and sixth guide members 34, 35 which are between the printing station 22 and the take-up spool 20. One of the movable ribbon guide member parts 36*a*, is movable in the space 38 between the second and third ribbon guides 31, 32 like the movable ribbon guide member 36 of FIG. 1, whilst the second movable ribbon guide member part 36*b* is movable in a space 38*a* between the further ribbon guides 50, 51. The two movable ribbon guide member parts 36*a*, 36*b* are movable in this example, along a common axis of movement, which is in the example parallel to the direction of movement of the substrate 24 through the printing station 22.

During a printing operation, the two movable ribbon guide member parts 36*a*, 36*b* are movable together, in the first direction 1, i.e. towards the second and third ribbon guides 31, 32 with this layout whilst their respective spacing is kept constant. The two movable ribbon guide member parts 36*a*, 36*b* will act as a shuttle to move the ribbon 16 though the printing station 22 whilst both of the storage 15 and take-up spools 20 remain stationary.

At the end of a printing operation the first and second movable ribbon guide member parts 36*a*, 36*b* are moved together in the second direction 2 opposite to the first direction 1, together, whilst both of the storage and take-up spools 15, 20 are rotated to pass fresh ribbon 16 to the ribbon path from the storage spool 15 and to take-up used ribbon 16 onto the take-up spool 20 from the ribbon path.

The first and second movable guide member parts 36*a*, 36*b* are movable relatively towards one another to increase ribbon tension in the ribbon path, or away from one another to decrease ribbon tension in the ribbon path at least when the ribbon 16 is stationary, i.e., in between printing operations and either before or preferably after, any ribbon 16 winding. Either or both of the respective first and second movable ribbon guide member part 36*a*, 36*b* drive motors 40*a*, 40*b* may be operated to move the respective guide member parts 36*a*, 36*b* together or apart.

In another example, the two guide member parts 36*a*, 36*b*, may otherwise be relatively movable, e.g. along non-coextensive, or even non-parallel paths, as required.

In each case, the controller 28, when responding to a signal from the ribbon tension sensor 45, may according to a programmed logic, move one or both of the movable ribbon guide member parts 36*a*, 36*b* to increase or decrease ribbon tension in the ribbon path. As with the FIG. 1 embodiment, the printing apparatus 110 may simply be calibrated so that the controller 28 responds to the magnitude of the signal from the ribbon tension sensor 45, or the controller 28 may be programmed with some algorithm which calculates the amount of differential ribbon guide member part 36*a*, 36*b* movement, to return or maintain the ribbon tension to within the predetermined limits.

As with the FIG. 1 embodiment, ribbon saving techniques may be employed, for example by moving the ribbon 16 through the printing station 22 at a slower speed than the substrate 24 is moving, and/or by re-using at least some of the ribbon 16 by either reintroducing to the ribbon path at least some used ribbon 16 from the take-up spool 20, or by not advancing, or not fully advancing the ribbon 16 towards the take-up spool 20 inbetween printing operations for example by moving the movable ribbon guide member parts 36*a*, 36*b* in the second direction 2, but not rotating the spools 15, 20, or at least not rotating the spools 15, 20 sufficiently so that entirely fresh ribbon 16 is used in a subsequent printing operation.

Figure 3:
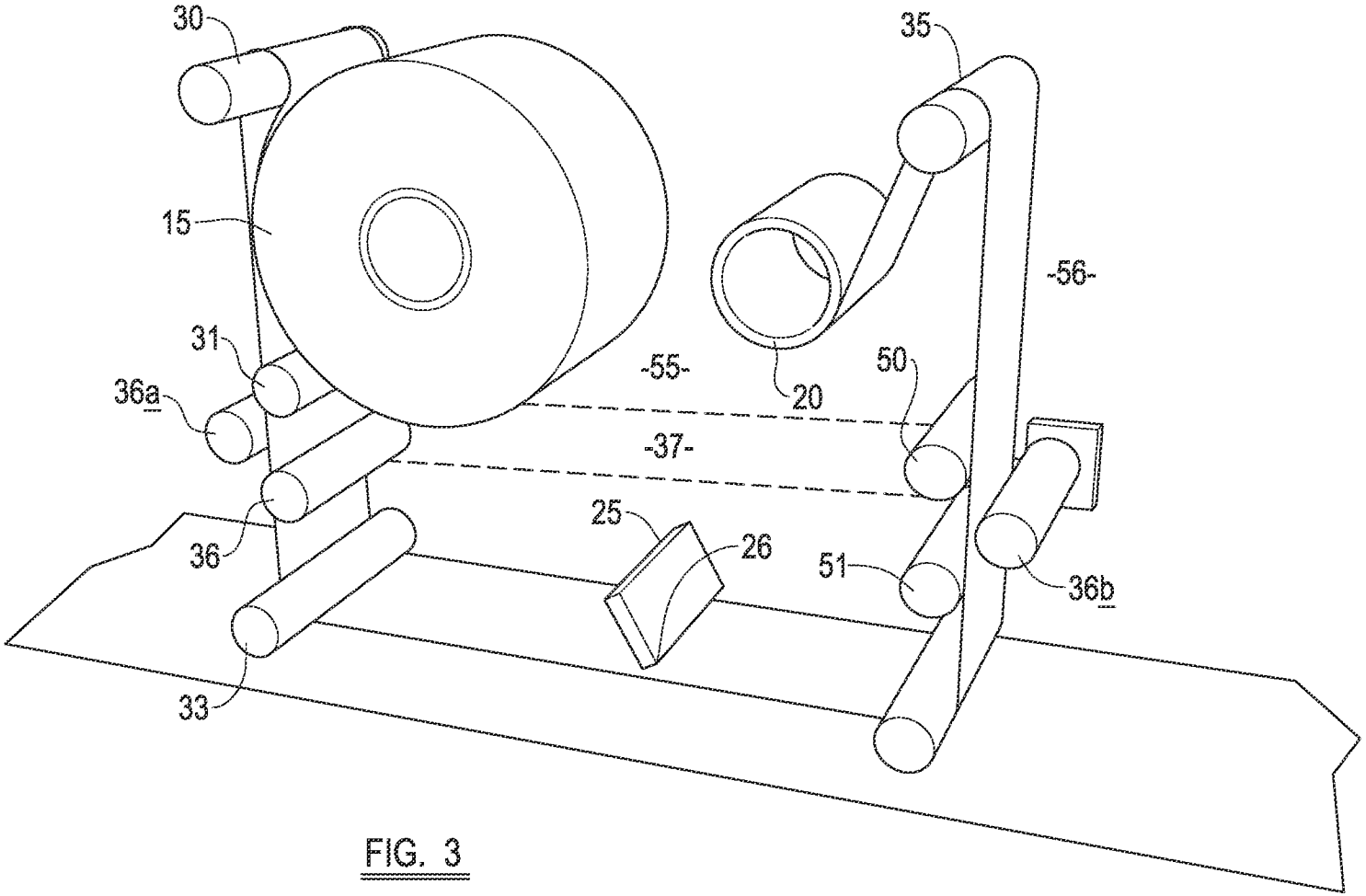
FIG. 3 is a view similar to FIG. 2 during a cassette loading stage.

FIG. 3 shows the printing apparatus of FIG. 2 during cassette loading. The FIG. 2 embodiment may utilise a base 11 which includes a cassette 55 carrying the storage and take-up spools 15, 20, and all of the respective ribbon guides 30-35 and 50, 51. In another example, not all the ribbon guides 30-35 and 50, 51 may be carried by the cassette.

To facilitate loading the cassette 55 to a fixed base part 56, the ribbon guide member parts 36*a*, 36*b* are differentially moved apart by their respective drive motors 40*a* and 40*b* and lead screws 41 to a maximum extent, outside of the boundary of the ribbon path.

FIG. 3 shows the cassette 55 and fixed base part 56 at this stage of loading. The two movable ribbon guide member parts 36*a*, 36*b* are then moved towards one another, e.g. along the slot the position of which is shown at 37 in FIG. 3 only, towards the positions in which they are shown in FIG. 2, when ribbon 16 will be drawn from the ribbon path so as to be entrained about the ribbon guide member parts 36*a*, 36*b*.

Figure 4:
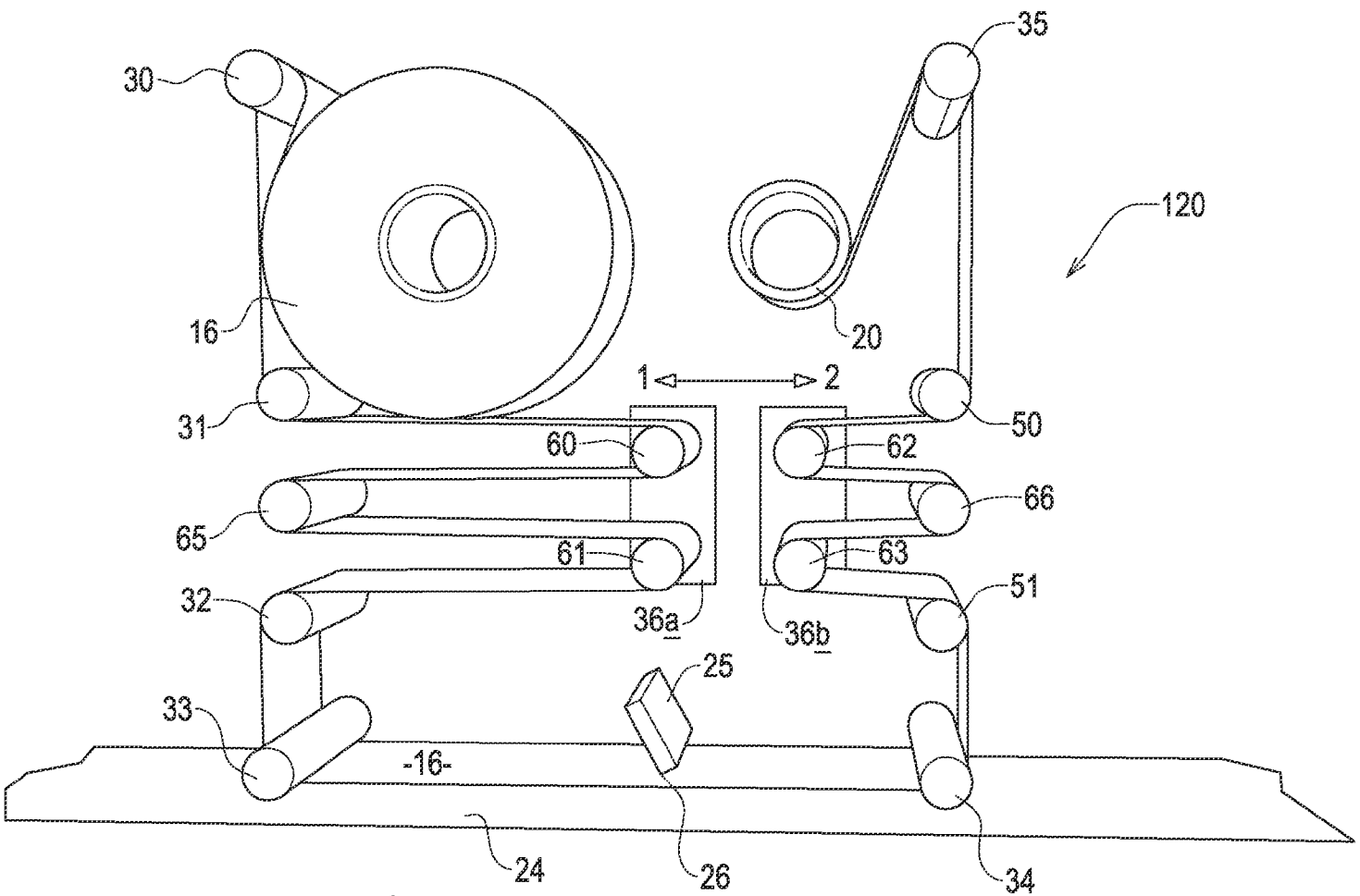
FIG. 4 is a view similar to FIG. 2 but including a modification.

FIG. 4 illustrates a modification to the embodiment illustrated in FIGS. 2 and 3, in that in a printing apparatus 120 each movable ribbon guide member part 36*a*, 36*b* includes a pair of guide elements 60, 61 and 62, 63 respectively, about which the ribbon 16 is entrained. Also in the ribbon path the base 11 mounts a yet further fixed two ribbon guides 65, 66.

One of the yet further fixed ribbon guides 65 is positioned between the second and third ribbon guides 31, 32 which are between the printing station 22 and the storage spool 15. The ribbon 16 is entrained about the second ribbon guide 31, then one of the guide elements 60 of the first movable ribbon guide member part 36*a*, then about the yet further ribbon guide 65, and then the other of the guide elements 61 of the first movable guide member part 36*a*, before being entrained about the third guide member 32.

The other yet further fixed ribbon guide 66 is positioned between the further pair 50, 51 of ribbon guides (which are not present in the FIG. 1 embodiment). The ribbon 16 is entrained about one of the further ribbon guides 50 (that adjacent to the sixth ribbon guide 35) then one of the guide elements 62 of the second movable ribbon guide member part 36*b*, then about the yet further ribbon guide 66, and then the other of the guide elements 63 of the second movable guide member parts 36*b*, before being entrained about the other 51 of the further pair of guide members 50, 51.

In this arrangement, when the first and second movable ribbon guide member parts 36*a*, 36*b* are moved together in the first direction 1, this will result in a greater corresponding movement of the ribbon 16 though the printing station 22 to that achieved with the unmodified embodiment of FIG. 2, so that the respective ribbon guide member part drive motors 40*a*, 40*b* etc. and the general mounting arrangements of the movable ribbon guide member parts 36*a*, 36*b* do not need to be able to drive the guide member parts 36*a*, 36*b* so far in the first and second directions 1, 2.

In accordance with the third aspect of the invention, in the FIG. 4 embodiment, the first and second movable guide member parts 36*a*, 36*b* need not be differentially movable to adjust ribbon tension, which may elsehow be controlled, for example by suitable operation of the storage spool motor 14 and/or the take-up spool motor 19.

Various modifications may be made to the embodiments described without departing from the scope of the invention.

Although in the examples described of continuous printing, the print head 25 is held stationary at the printing station 22, in another example if desired the print head 25 may be movable during printing, in the direction of substrate 24 movement or oppositely, to vary the differential speed at which the substrate 24 passes the print head 25. For example the print head 25 may be moved to accommodate changes in substrate 24 speed during a printing operation.

In each case, desirably there is an input to the controller indicative of substrate 24 speed so that the controller 28 can control the ribbon 16 speed through the printing station 22 either to match the ribbon speed as close a possible to the substrate 24 speed or to maintain a desired differential speed between them. The printing apparatus 10, 110, 120 may thus include a substrate speed sensor, but an input indicating substrate 24 speed, may be provided by an external sensor.

Although the invention has been described with reference to examples which are thermal printers, the invention may be applied to any kind of printer in which there is a printing ribbon and a print head, where it is desirable to control the ribbon tension in a ribbon path through the printing apparatus 10, 110, 120.

In the examples, the moveable ribbon guide member drive device includes one or more stepper motors, but the or one of the motors 40, 40*a*, 40*b* can be an alternative kind of motor, provided that this can be closely controlled by the controller.

Similarly although preferably both spool drive motors 14, 19 are stepper motors, one or other of these may be another kind of motor.

In another embodiment a ribbon tension sensor device may be provided along the ribbon path which is not included in a guide member such as sensor 45 on guide member 33. For one example, the guide member drive motor 40 (as in FIG. 1) or one of the guide member drive motors 40*a*, 40*b* (as in FIG. 2) can instead of being a stepper motor as described above, be a d.c. motor for example. A signal indicative of ribbon tension in the ribbon path may be derived by determining the current consumed by the d.c. motor when operated to move the guide member 36 or respective guide member 36*a*, 36*b*.

Other ribbon tension sensing devices can be used.

In the generality, the present invention utilises a movable ribbon guide member 36 or 36*a*, 36*b*, which is driven by a motor or motors by a controller 28, in response to a ribbon 16 tension sensor 45 input, to adjust ribbon tension, whereas FIG. 4 illustrates a printing apparatus 120 with an improved ribbon 16 drive.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A printing apparatus for printing on a substrate, the apparatus including a base mounting a storage spool to store ribbon of a kind including a web carrying marking medium, and the base mounting a ribbon take-up spool to take up ribbon, and there being a ribbon path from the storage spool to the take-up spool through a printing station where there is a print head, printing being effected at the printing station when relatively moving the print head and the substrate with the ribbon interposed between substrate and print head so that marking medium is transferred from the web of the ribbon to the substrate, and wherein the apparatus includes a movable ribbon guide member including a pair of ribbon guide member parts about which the ribbon is entrained along the ribbon path, a ribbon guide member drive device including a pair of ribbon guide member part drive motors to move respective ribbon guide member parts of the movable ribbon guide member, and there being a controller which, during or in between at least some printing operations, controls drive of at least the take-up spool to advance ribbon through the printing station, wherein the pair of ribbon guide member parts being movable in a first direction during printing, to effect ribbon movement through the printing station, and the ribbon guide member parts additionally being movable relative to one another via the controller controlling the ribbon guide member part drive motors in response to a ribbon tension input signal representative of ribbon tension along the ribbon path to adjust the ribbon tension in the ribbon path between predetermined tension limits.

2. A printing apparatus according to claim 1 wherein the controller causes the movable ribbon guide member to move before or after a printing operation to adjust the ribbon tension.

3. A printing apparatus according to claim 1 wherein at least one of the ribbon guide member part drive motors turns a lead screw which is received by a female threaded transmission part of the corresponding movable ribbon guide member part.

4. A printing apparatus according to claim 1 wherein at least one of the ribbon guide member part motors drives a drive belt which carries the corresponding movable ribbon guide member part, the drive belt being entrained around a pair of spindles, at least one of which is drivable by the corresponding ribbon guide member part motor to effect ribbon guide member movement.

5. A printing apparatus according to claim 1 wherein during printing the storage spool and the take-up spool are both stationary.

6. A printing apparatus according to claim 1 wherein after a printing operation, the pair of ribbon guide member parts move in a second direction opposite to the first direction, while the storage spool and the take-up spool both rotate, with the take-up spool taking-up used ribbon from the ribbon path and the storage spool passing fresh ribbon into the ribbon path ready for a subsequent printing operation.

7. A printing apparatus according to claim 1 wherein movement of the pair of ribbon guide member parts relative to one another is effected when the ribbon is stationary.

8. A printing apparatus according to claim 1 wherein a distance between the pair of ribbon guide member parts is adjustable by the operation of at least one of the ribbon guide member part drive motors.

9. A printing apparatus according to claim 8 wherein each of the ribbon guide member part drive motors drives a respective one of the ribbon guide member parts in the first direction and a second direction opposite to the first direction.

10. A printing apparatus according to claim 9 wherein the ribbon guide member part drive parts are stepper motors.

11. A printing apparatus according to claim 1 wherein each of the ribbon guide member parts of the pair of ribbon guide member parts, includes a pair of movable ribbon guide member elements about which the ribbon is entrained, the ribbon being entrained about a base-mounted ribbon path guide inbetween being entrained about the respective ribbon guide member elements.

12. A printing apparatus according to claim 1 wherein the printing apparatus includes a ribbon tension sensing device to sense ribbon tension in the ribbon path and to provide the ribbon tension input signal to the controller.

13. A printing apparatus according to claim 12 wherein the sensing device includes a strain sensor incorporated into a base mounted ribbon path guide.

14. A printing apparatus according to claim 13 wherein the sensing device senses tension related movement of a base mounted guide.

15. A printing apparatus according to claim 1 wherein the substrate moves through the printing station with the ribbon during a print operation.

16. A printing apparatus according to claim 1 wherein the printing apparatus is a thermal printing apparatus in which the print head includes a plurality of thermal heating elements which are selectively energisable by a controller during printing to soften and remove pixels of marking medium from the ribbon and to transfer such pixels to the substrate.

17. A method of operating a printing apparatus, the apparatus including a base mounting a storage spool for storing ribbon of a kind including a web carrying marking medium, and the base mounting a ribbon take-up spool for taking up ribbon, and there being a ribbon path from the storage spool to the take-up spool through a printing station where there is a print head, printing being effected at the printing station when relatively moving the print head and a substrate with the ribbon interposed between the substrate and the print head so that marking medium is transferred from the web of the ribbon to the substrate, and wherein the apparatus includes a movable ribbon guide member including a pair of ribbon guide member parts about which the ribbon is entrained along the ribbon path, the pair of ribbon guide member parts being movable in a first direction during printing, to effect ribbon movement through the printing station, and a ribbon guide member drive device including ribbon guide member part drive motors for moving the ribbon guide member parts, and there being a controller which, during or in between at least some printing operations, controls drive of at least the take-up spool to advance ribbon through the printing station, the method including controlling by the controller the ribbon guide member parts, relative to each other, via the ribbon guide member drive device in response to a ribbon tension signal representative of ribbon tension along the ribbon path to adjust ribbon tension in the ribbon path.

18. A method according to claim 17, comprising keeping both the storage spool and the take-up spool stationary during printing, and effecting movement of the pair of ribbon guide member parts relative to one another when the ribbon is stationary.

19. A method according to claim 17, comprising moving the substrate through the printing station with the ribbon during a print operation, and selectively energizing thermal heating elements of the print head during printing to soften and remove pixels of marking medium from the ribbon and to transfer such pixels to the substrate.

20. A printing apparatus for printing on a substrate, the apparatus including a base mounting a ribbon storage spool and a ribbon take-up spool to take-up ribbon, and there being a ribbon path from the storage spool to the take-up spool through a printing station where there is a print head, and wherein the apparatus includes a ribbon guide member including a pair of ribbon guide member parts about which the ribbon is entrained along the ribbon path, a ribbon guide member drive device including a pair of ribbon guide member part drive motors to move respective ribbon guide member parts, the ribbon guide member parts being movable in a first direction by the ribbon guide member part drive motors to effect ribbon movement at the printing station, wherein the pair of ribbon guide member parts additionally are movable relative to one another to adjust ribbon tension in the ribbon path, and wherein each of the ribbon guide member parts includes a pair of ribbon guide member elements about which the ribbon is entrained, the ribbon being entrained about a base-mounted ribbon path guide in between being entrained about the respective guide member elements.

21. A printing apparatus according to claim 20, wherein during printing the storage spool and the take-up spool are both stationary, and wherein movement of the pair of ribbon guide member parts relative to one another is effected when the ribbon is stationary.

22. A printing apparatus according to claim 20, wherein the substrate moves through the printing station with the ribbon during a print operation, and wherein the printing apparatus is a thermal printing apparatus in which the print head includes a plurality of thermal heating elements which are selectively energisable by a controller during printing to soften and remove pixels of marking medium from the ribbon and to transfer such pixels to the substrate.

* * * * *